US008297010B2

(12) United States Patent
Giarratana

(10) Patent No.: US 8,297,010 B2
(45) Date of Patent: Oct. 30, 2012

(54) ADJUSTABLE STAIR RISER AND METHOD OF INSTALLING SAME

(76) Inventor: Stephen Giarratana, Rockfall, CT (US)

( * ) Notice: Subject to any disclaimer, the term of this patent is extended or adjusted under 35 U.S.C. 154(b) by 46 days.

(21) Appl. No.: 12/403,409

(22) Filed: Mar. 13, 2009

(65) Prior Publication Data

US 2010/0229478 A1 Sep. 16, 2010

(51) Int. Cl.
*E04F 11/09* (2006.01)

(52) U.S. Cl. ..... 52/182; 52/741.2

(58) Field of Classification Search ..... 52/188, 52/182, 179, 741.2, 191, 288.1, 287.1, 717.03; 182/230

See application file for complete search history.

(56) References Cited

U.S. PATENT DOCUMENTS

| | | | | | |
|---|---|---|---|---|---|
| 216,405 | A | | 6/1879 | Heywood | |
| 316,715 | A | * | 4/1885 | Woelfle | 52/288.1 |
| 599,395 | A | * | 2/1898 | Liebreich | 52/287.1 |
| 794,908 | A | | 7/1905 | Winslow | |
| 868,430 | A | * | 10/1907 | Grossman | 52/182 |
| 932,679 | A | | 8/1909 | Coleman | |
| 1,166,428 | A | | 1/1916 | Brooks | |
| 1,412,899 | A | * | 4/1922 | Hugo | 52/188 |
| 1,605,573 | A | * | 11/1926 | Stedman | 52/288.1 |
| 2,206,862 | A | * | 7/1940 | Boyd | 52/182 |
| 2,827,675 | A | * | 3/1958 | Nelson | 52/179 |
| 3,562,981 | A | * | 2/1971 | Willfurth | 52/211 |
| 3,564,797 | A | * | 2/1971 | Willfurth | 52/287.1 |
| 3,982,608 | A | | 9/1976 | Booth | |
| 4,991,691 | A | * | 2/1991 | Brawer et al. | 182/106 |
| 5,575,353 | A | * | 11/1996 | Cafaro | 182/106 |
| 6,012,254 | A | * | 1/2000 | Gaston | 52/102 |
| 6,119,420 | A | * | 9/2000 | Koenig et al. | 52/255 |
| 6,467,234 | B1 | * | 10/2002 | Marshall | 52/741.2 |
| 6,895,717 | B1 | | 5/2005 | Grinstead | |
| 6,960,273 | B2 | | 11/2005 | Jung | |
| 2004/0111979 | A1 | * | 6/2004 | Koehler et al. | 52/23 |
| 2006/0230693 | A1 | * | 10/2006 | Giordano | 52/182 |

FOREIGN PATENT DOCUMENTS

| | | | | |
|---|---|---|---|---|
| GB | 2110737 | A | * | 6/1983 |
| GB | 2196035 | A | | 4/1988 |
| JP | 01174757 | A | * | 7/1989 |
| JP | 02030843 | A | * | 2/1990 |
| JP | 05156769 | A | * | 6/1993 |
| JP | 2004156307 | A | | 6/2004 |

OTHER PUBLICATIONS

Machine translation for JP 05156769 A.*

* cited by examiner

*Primary Examiner* — Christine T Cajilig
(74) *Attorney, Agent, or Firm* — McCormick, Paulding & Huber LLP

(57) ABSTRACT

An adjustable stair riser includes a body portion made of a flexible material. An upper connecting portion is disposed adjacent to an upper end of the body portion. A lower connecting portion is disposed adjacent to a lower end of the body portion. A front surface of the body portion is concavely shaped between the upper and lower ends so as to create slack for moving the upper and lower ends toward or away from each other to accommodate spacing between adjacent treads of a stairway during installation. The concavely shaped front surface of the body portion additionally provides an obstruction free path of foot travel.

16 Claims, 4 Drawing Sheets

ADJUSTABLE STAIR RISER AND METHOD OF INSTALLING SAME

FIELD OF THE INVENTION

This invention generally relates to stairways, and more particularly relates to a flexible, adjustable height stair riser for installation on new or previously-built riserless stairways.

BACKGROUND OF THE INVENTION

Stairways preferably have risers having a lower end coupled to a rear of a tread, and having an upper end coupled to a front of the next higher tread in the stairway. However, it is still common to find stairways, such as those outside or leading into a basement, which do not include risers. Such riserless stairways can lead to small objects possibly passing through the opening between adjacent treads. More specifically, a small animal such as a pet or even a small child or infant could accidentally fall through the opening and injure itself.

It is therefore a general object of the present invention to provide a stair riser which can be adjusted in height so as to be installed on new or previously built riserless stairways requiring risers of various heights.

SUMMARY OF THE INVENTION

In an aspect of the present invention, an adjustable stair riser includes a body portion made of a flexible material. An upper connecting portion is disposed adjacent to an upper end of the body portion. A lower connecting portion is disposed adjacent to a lower end of the body portion. A front surface of the body portion is concavely shaped between the upper and lower ends so as to create slack for moving the upper and lower ends toward or away from each other to accommodate spacing between adjacent treads of a stairway.

In a second aspect of the present invention, a method of installing an adjustable riser on a stairway includes placing an adjustable riser having a lower end, a body portion and an upper end between adjacent treads of a stairway. The spacing between the upper end and the lower end is adjusted such that an upper connecting portion extending from the upper end is aligned over an upper front portion of a tread of a stairway, and such that a lower connecting portion extending from the lower end is aligned over a lower rear portion of a tread of a stairway. The upper connecting portion is coupled to the upper tread and the lower connecting portion is coupled to the lower tread.

In a third aspect of the present invention, a method of installing an adjustable riser on a stairway includes placing an adjustable riser having a body portion between adjacent treads of a stairway. The spacing between an upper end and a lower end of the body portion is adjusted such that an upper connecting portion extending from the body portion adjacent to the upper end is aligned over a stringer of a stairway, and such that a lower connecting portion extending from the body portion adjacent to the lower end is aligned over the stringer of the stairway. The upper connecting portion and the lower connecting portion are coupled to the stringer.

BRIEF DESCRIPTION OF THE PREFERRED EMBODIMENT

Figure 1:
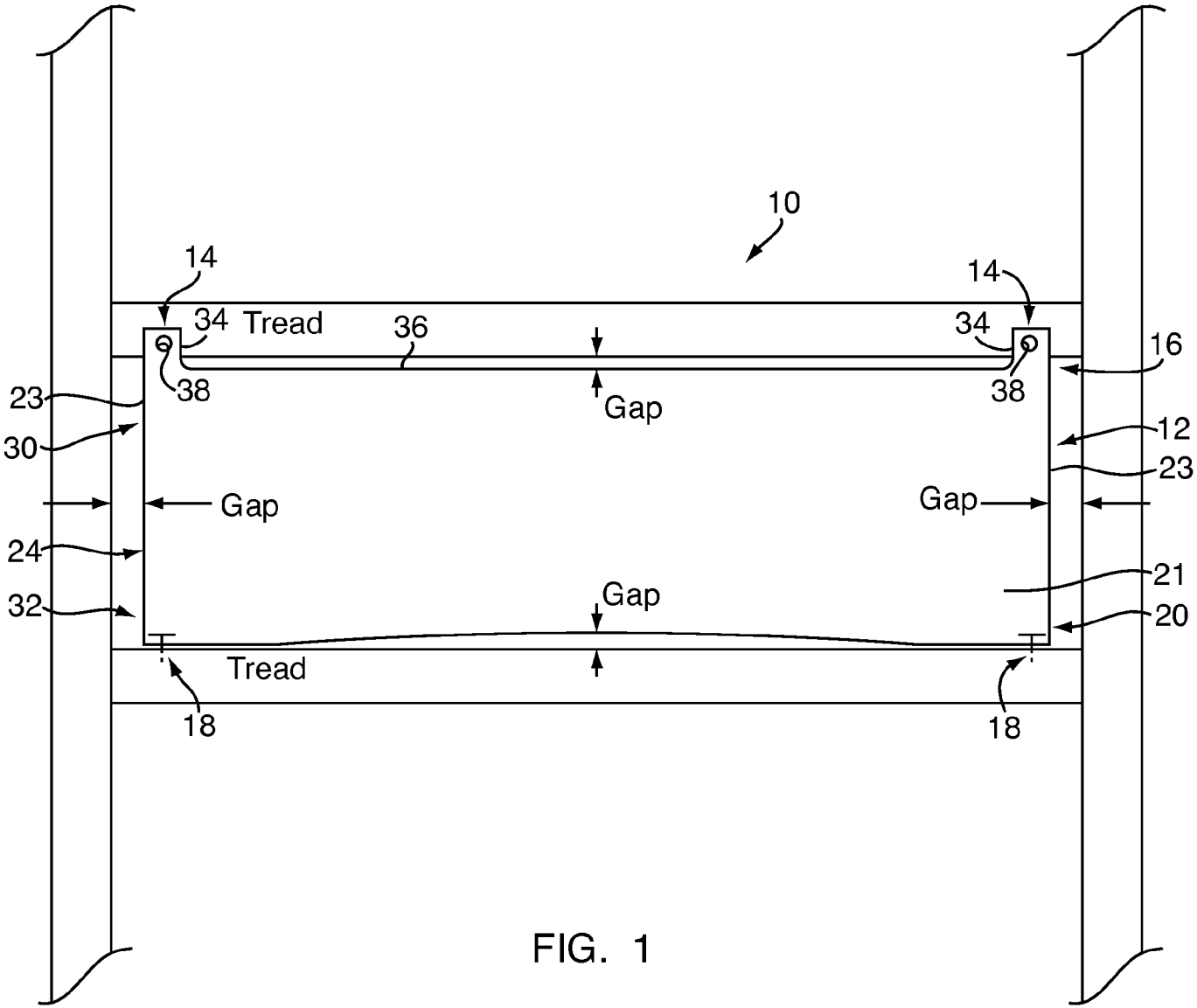
FIG. 1 is a front view of an adjustable stair riser embodying the present invention.
Figure 2:
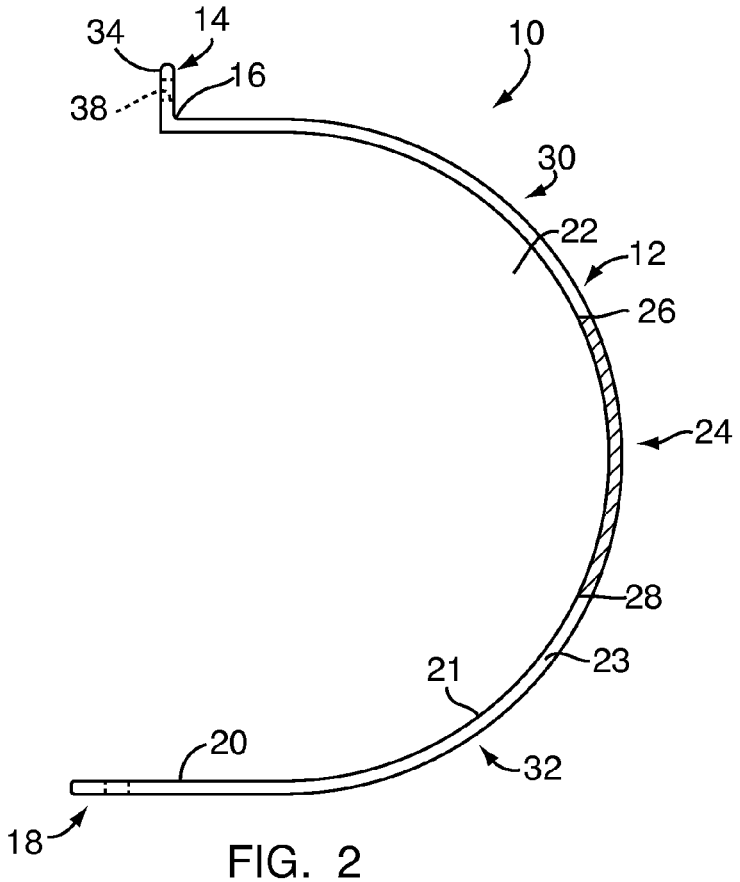
FIG. 2 is a side view of the stair riser.
Figure 3:
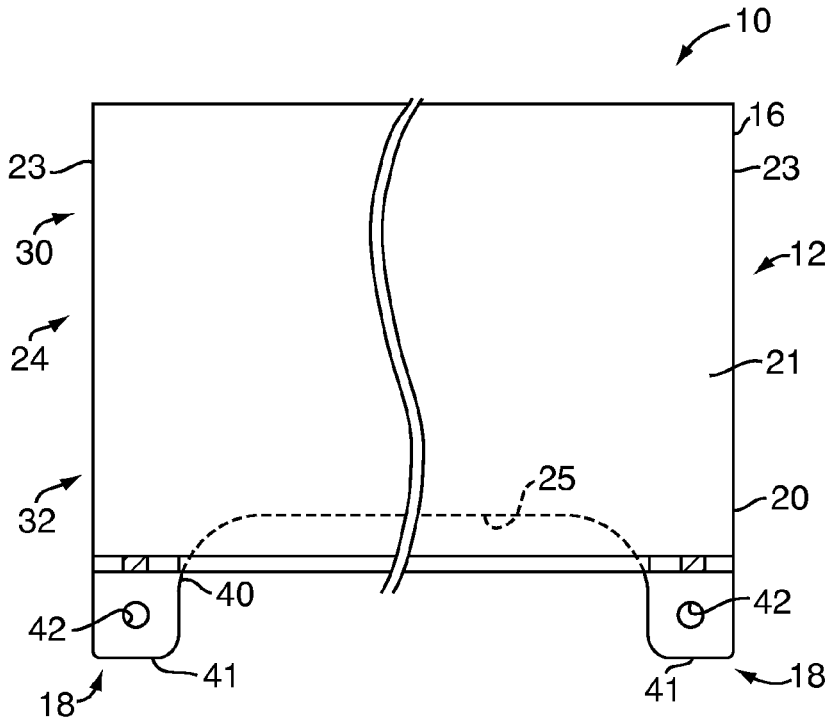
FIG. 3 is a top plan view of the stair riser.

With reference to FIGS. 1-3, a stair riser embodying the present invention is indicated generally by the reference number 10. The stair riser 10 is adapted for installation on new or previously-built riserless stairways that are either interior or exterior where appearance has lower priority than safety and function. Typical stairways for employing the stair riser 10 include, for example, basement, attic and garage stairways. The stair riser 10 is at least partially made of a flexible material such as, but not limited to, extruded or molded recycled or other type of plastic, or sheet metal for heavy duty use. For example, the plastic can be injection molded or extrusion/cut to length. The stair riser 10 is preferably a one piece construction and includes a body portion 12, an upper connecting portion 14 disposed at an upper end 16 of the body portion, and a lower connecting portion 18 disposed at a lower end 20 of the body portion. The upper and lower connecting portions 14, 18 are configured for being coupled respectively to upper and lower treads of a stairway.

A front surface 21 of the body portion 12 is concavely shaped between the upper end 16 and the lower end 20 so as to create slack for moving the upper end and the lower end toward or away from each other in order to establish the correct riser height depending on the spacing between treads on the stairway on which the stair riser 10 is being installed. Preferably, the concave shape of the body portion 21 is configured to flex so as to accommodate various riser heights in the range of about 6 inches to about 8 inches. Moreover, the concave shape of the body portion 12 provides strength along a width extending between side edges 23 of the body portion, and also forms a recess 22 for accommodating foot traffic or preventing toes from striking an otherwise straight and rigid riser. More specifically, the recess 22 permits unobstructed foot travel otherwise impeded by debris such as snow or foliage. Conventional designs such as flat shapes do not offer relief.

By way of example only, the width between the side edges 23 can be up to about 33 inches, and the curved cross section of the concavely shaped recess can be up to 6 inches+/−2 inches. In addition, the lower end 20 of the body portion 12 between the side edges 23 of the body portion defines an inwardly extending relief edge 25 to provide a gap between the lower center part of the riser 10 and rear edge of tread to allow dirt/sand, rain/snow passage to prevent debris accumulation. The gap should be large enough for passage of fingers for ease of installation, but less than four inches per USA and Canadian building safety codes such as ANSI, ICC and BOCA.

At least part of the concavely shaped body portion 12 as seen in the end view of FIG. 2 is semi-circular or C-shaped when not under tension or compression, but can take other curved shapes without departing from the scope of the present invention. A central region 24 of the body portion 12 from 26 to 28 preferably is a thin section region having a relatively reduced thickness relative to an upper region 30 and a lower region 32 of the body portion. By way of example only, the central region 24 is about ⅛ inch in thickness, whereas the upper region 30 and the lower region 32 is about 3/16 inch in thickness. The thin section region enables the flexing and bending of the stair riser 10 while keeping the front surface 21 horizontally disposed adjacent to the mounting surfaces of the upper connecting portion 14 and the lower connecting portion 18. This horizontal disposition of the front surface 21 enables better alignment over stairway tread surfaces and therefore the formation of stronger connection points. Moreover, the concavely shaped body portion 12 provides unobstructed foot travel otherwise impeded by debris such as snow and foliage debris clearance for dirt and snow.

Figure 4:
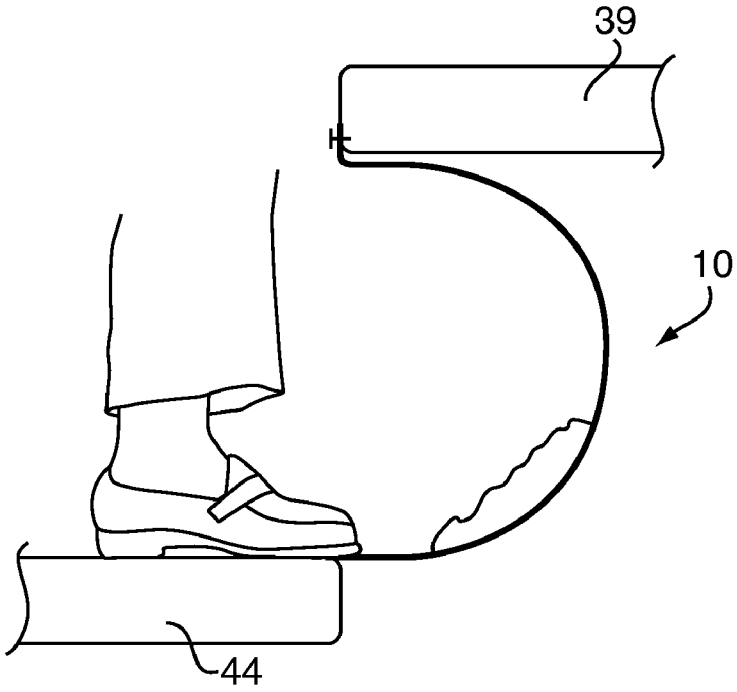
FIG. 4 is a side view of the stair riser installed on a stairway.

The upper connecting portion 14 preferably includes two projections 34 extending outwardly from an upper edge 36 of the body portion 12. As shown in FIG. 1, the two projections 34 each can be in the form of tab flanges disposed at each side of the upper edge 36 (i.e., upper left and right edges as seen while facing stairway). The tab flanges 34 are disposed at the sides of the upper edge 36 to avoid any impediment to foot travel. The projections or tab flanges 34 preferably each define a hole 38 for receiving a fastener therethrough. For wood stair treads, the fasteners can be, for example, nails or wood screws. For metal stair treads, the fasteners can be, for example, metal screws or hilti-gun. For concrete stair treads, the fasteners can be, for example, epoxy or wedge anchors. As best shown in FIG. 2, the two projections 34 each extend upwardly in a direction generally transverse to that of the upper end 16 of the body portion 12 to enable the projections 34 to be coupled to a frontward facing surface or leading edge of an upper tread 39 (see FIG. 4).

Similarly, the lower connecting portion 18 preferably includes two projections 41 extending outwardly from a lower edge 40 of the body portion 12. As shown in FIG. 3, the two projections 41 each can be in the form of tab flanges disposed at each side of the lower edge 40 (i.e., lower left and right edges as seen while facing stairway). The tab flanges 41 are disposed on the sides of the lower edge 40 to avoid any impediment to foot travel. The projections or tab flanges 41 preferably each define a hole 42 for receiving a fastener such as a nail or screw therethrough. As best shown in FIG. 2, the two projections 41 each extend outwardly from the lower end 20 of the body portion 12 to enable the projections 41 to be coupled to an upwardly facing surface of a lower tread 44 (see FIG. 4).

Incidental foot strikes or snow shovel impacts can be absorbed without damage to material used (plastic) in riser 10. The curved cross section of the riser 10 provides more material (2×) and distributes energy evenly as compared to a rectangular (straight cross section) riser which would have stress concentration areas. Moreover, over several years, UV sunlight and wind gusts add to material stress. The curved cross section of the riser 10 gives the material (plastic) the ability to better endure the elements relative to conventional risers.

The stair riser 10 is installed by placing the riser between adjacent treads of a stairway. The spacing between the upper end 16 and the lower end 20 is adjusted such that the upper connecting portion 14 extending from the upper end is aligned over an upper front portion of a tread of a stairway, and such that the lower connecting portion 18 extending from the lower end is aligned over a lower rear portion of a tread of a stairway. A vertical flex of the concavely shaped body portion 12 acts as a tension spring to help hold itself in place while fasteners are installed through the upper connecting portion 14 and the lower connecting portion 18. The upper connecting portion 14 is coupled to the upper tread and the lower connecting portion 18 is coupled to the lower tread from a position in front of the stairway.

In summary, riser method permits installation of stairway risers from the front (traveled) side of stairway. In other words, the riser installation method provides the convenience of being able to install from the front of stairs while kneeling or standing on stairway. The curved/flexible cross section of each riser element acts as a temporary holding spring allowing the person performing the installation to free his/her hands to add fasteners. The curved/flexible cross section also allows for varying stairway step heights; traditional methods, on the other hand, require custom cutting and fit-up carpentry skills. The midsection of the curved cross section is a thinner material thickness for more bending in order to keep upper and lower mount surfaces level to stairs. The four (4) tab flanges allow simple fastening. The tab flanges are at the extreme side ends. Using this riser installation method allows open clearance for pedestrian foot travel, snow shovels and brooms. The riser installation method allows simplicity, comfort and safety for the person performing the installation. Traditional methods use straight and rigid risers that require rear nailing from behind the stairway on ladders.

Figure 5:
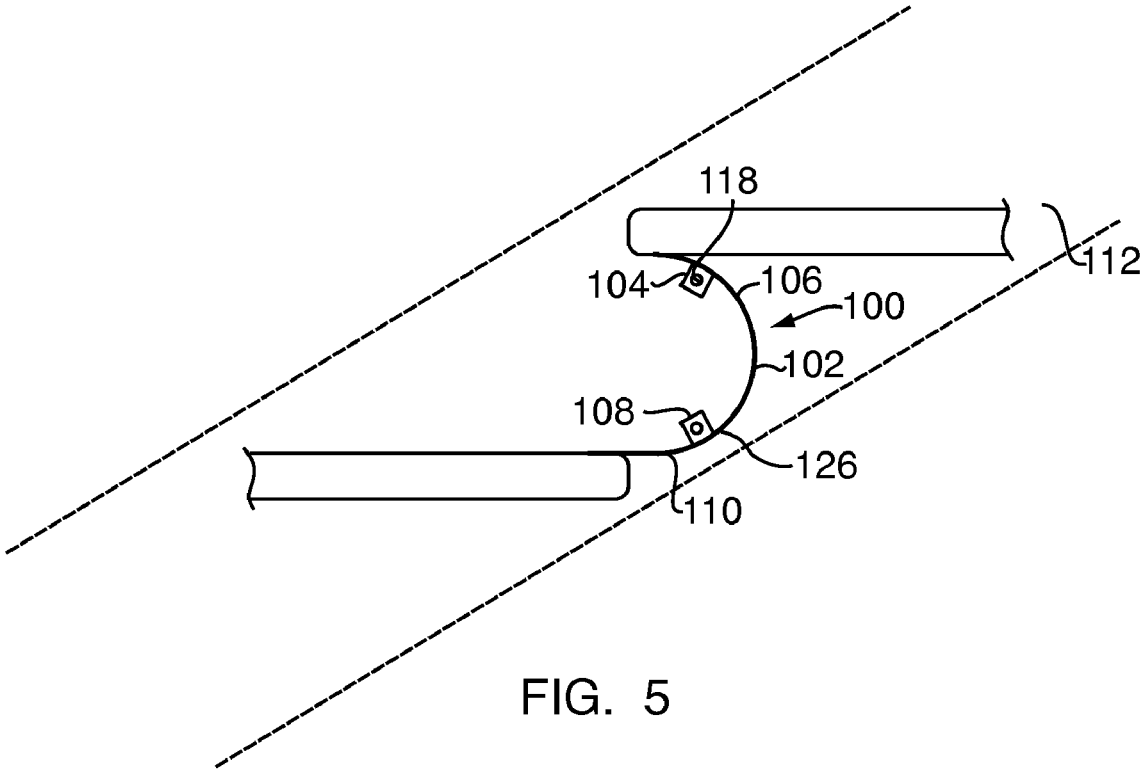
FIG. 5 is a side view of a stair riser installed on a stairway in accordance with a second embodiment of the present invention.

With reference to FIG. 5, a stair riser in accordance with a second embodiment of the present invention is indicated generally by the reference number 100. The stair riser 100 is generally the same as that of the stair riser 10 except for the upper and lower connecting portions, and therefore the similar features will not be repeated in detail.

The stair riser 100 is preferably made of a flexible material such as, but not limited to, sheet metal for heavy duty use in industrial or commercial environments. The stair riser 100 includes a body portion 102, an upper connecting portion 104 disposed adjacent to an upper end 106 of the body portion, and a lower connecting portion 108 disposed adjacent to a lower end 110 of the body portion. The upper and lower connecting portions 104, 108 are configured for being coupled to stringers 112 on each side of the stair riser 100.

The upper connecting portion 104 preferably includes two projections (only one shown) extending upwardly from upper side edges of the body portion 102. The two projections can be in the form of tab flanges disposed at each of the upper side edges. The projections or tab flanges preferably each define a hole 118 for receiving a fastener such as a nail or screw therethrough. The two projections each extend upwardly in a direction generally transverse to that of the upper end 106 of the body portion 102 to enable the projections to be coupled to a facing surface of a stringer 112.

Similarly, the lower connecting portion 108 preferably includes two projections (only one shown) extending upwardly from lower side edges of the body portion 102. The two projections can be in the form of tab flanges disposed at each of the lower side edges. The projections or tab flanges preferably each define a hole 126 for receiving a fastener such as a nail or screw therethrough. The two projections each extend upwardly in a direction generally transverse to that of the lower end 110 of the body portion 102 to enable the projections to be coupled to a facing surface of the stringer 112.

The stair riser 100 is installed by placing the riser between adjacent treads of a stairway. The spacing between the upper end 106 and the lower end 110 is adjusted such that the upper connecting portion 104 extending from the body portion 102 adjacent to the upper end is aligned over the stringer 112 of a stairway, and such that the lower connecting portion 108 extending from the body portion 102 adjacent to the lower end is aligned over the stringer 112 of the stairway. The upper connecting portion 104 and the lower connecting portion 108 are coupled to the stringer 112 from a position in front of the stairway.

Figure 6:
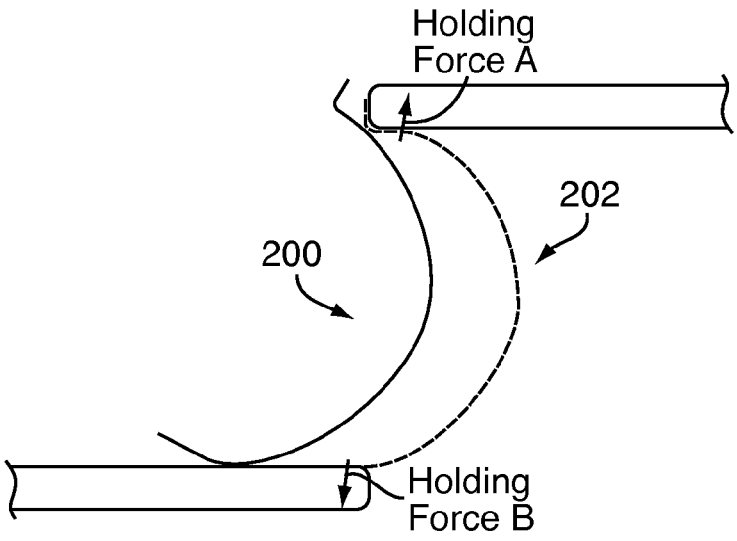
FIG. 6 is a side view of a stair riser in both an unrestrained state and an installed state.

FIG. 6 best illustrates the changes to the size and shape of a stair riser embodying the present invention in both an unrestrained state and in an installed state. The stair riser in an unrestrained state is shown in solid line and labeled by the reference number 200. The stair riser in an installed state is shown in broken line and labeled by the reference number 202. As can be clearly seen in FIG. 6, the size of the stair riser in the unrestrained state 200 is larger than the size of the stair riser after being pushed into the installed state 202. The stair riser when being pushed into the installed state 202 compresses the stair riser and its shape to generate minimal holding forces A and B which temporarily hold the stair riser in place while being fastened to treads or stringers of a stairway. The riser materials, dimensions and thickness create the minimal holding force such that any person (adult) can push or snap the stair riser into the installed state. Fasteners then can be easily installed by one person because the stair riser temporarily will hold itself in position by the minimal holding forces until fasteners are added to complete the installation.

Figure 7:
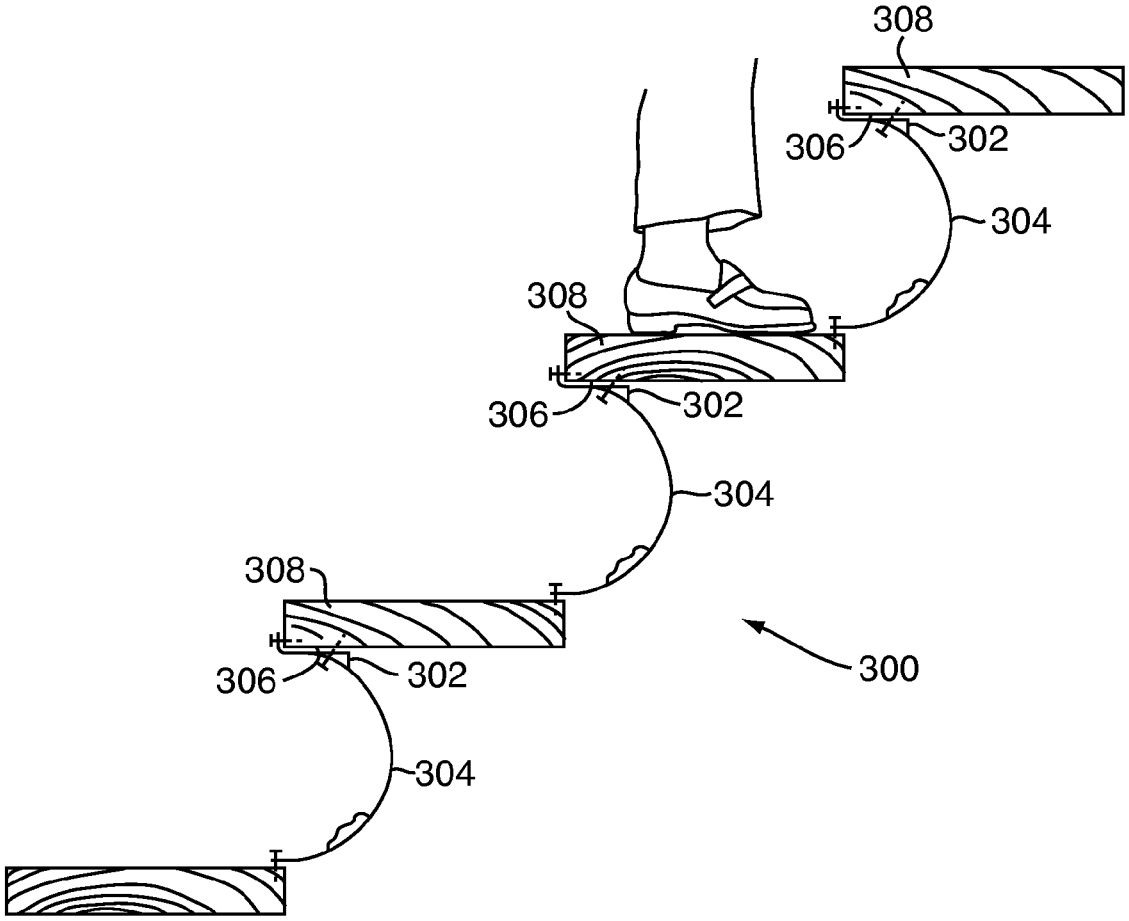
FIG. 7 is a side view of a stair riser installed on a stairway in accordance with a third embodiment of the present invention.

With reference to FIG. 7, a stair riser 300 in accordance with the present invention is similar to those shown in previous embodiments, but also include a molded or fabricated wedge backing 302 for applications where additional securing is desired or required by an architect or engineer. The additional securing is suitable, for example, for stairways in high wind areas, heavy snow regions, or for extra wide stairways. The wedge backing 302 is for reinforcement, and does not change or affect the overall flexibility or installation features of the stair riser 300. As shown in FIG. 7, the wedge backing 302 is interposed between a rear surface 304 of the stair riser 300 and a bottom forward surface 306 of an upper tread 308 relative to the stair riser. The wedge backing 302 is held in place by a fastener 310 such as a nail or screw placed through the stair riser 300, the wedge backing 302 and into the upper tread 308. The typical location of the wedge backing 302 is about midway (left to right) when facing a stairway head-on.

As will be recognized by those of ordinary skill in the pertinent art, numerous modifications and substitutions can be made to the above-described embodiments of the present invention without departing from the scope of the invention. Accordingly, the preceding portion of this specification is to be taken in an illustrative, as opposed to a limiting sense.

What is claimed is:

1. A stairway, comprising:

a first stair tread;

a second stair tread vertically displaced below the first stair tread; and an adjustable stair riser having:

a flexible concave body portion having a first vertical edge and a second vertical edge laterally displaced from said first vertical edge;

a first connecting portion on the flexible concave body portion at a first lateral edge extending horizontally between the first and second vertical edges, said first connecting portion configured for securement to a vertical front surface of the first stair tread;

a second connecting portion on the flexible concave body portion at an edge opposite the first lateral edge, said second connecting portion configured for securement to a top horizontal surface of the second stair tread, and said second connecting portion having a relief edge extending substantially between the first and second vertical edges, wherein by installation of said adjustable stair riser to said first and second stair treads, said relief edge is vertically displaced to form a gap adjacent the top horizontal surface of the second stair tread when the second connecting portion is secured thereto.

2. A srairway as defined in claim 1, wherein a central region of the body portion between the upper and lower ends is a thin region having a reduced thickness relative to an upper region and a lower region of the body portion.

3. A stairway as defined in claim 1, wherein the body portion includes extruded or molded plastic.

4. A stairway as defined in claim 1, wherein the body portion includes sheet metal.

5. A stairway as defined in claim 1, wherein the upper connecting portion includes two projections extending outwardly from an upper edge of the body portion, wherein the two projections of the upper connecting portion are configured to abut the upper tread.

6. A stairway as defined in claim 5, wherein the upper connecting portion includes two projections disposed at each transverse side of the upper edge.

7. A stairway as defined in claim 5, wherein each of the two projections each are in the form of a tab flange defining a hole for receiving a fastener therethrough.

8. A stairway as defined in claim 1, wherein the lower connecting portion includes two projections extending outwardly from a lower edge of the body portion, wherein the two projections of the lower connecting portion are configured to abut the lower tread.

9. A stairway as defined in claim 8, wherein the lower connecting portion includes two projections disposed at each side of the lower edge.

10. A stairway as defined in claim 8, wherein each of the two projections is in the form of a tab flange defining a hole for receiving a fastener therethrough.

11. A stairway, comprising:

a first stair tread;

a second stair tread vertically displaced below the first stair tread;

first and second laterally opposed stringers supporting the first stair tread and the second stair tread; and an adjustable stair riser having:

a flexible concave body portion having a first vertical edge, a second vertical edge laterally displaced from said first vertical edge, and a lower lateral edge shaped as a concave relief edge;

first upper and lower connecting portions spaced apart along the first vertical edge, said connecting portions configured for securement to the first stringer;

second upper and lower connecting portions spaced apart along the second vertical edge, said connecting portions configured for securement to the second stringer;

wherein by installation of said adjustable stair riser between said stringers, said concave relief edge is vertically displaced to form a gap adjacent a top horizontal surface of the second stair tread.

12. A stairway as defined in claim 11, wherein each of the two projections is in the form of a tab flange defining a hole for receiving a fastener therethrough.

13. A stairway as defined in claim 1, wherein the lower connecting portion includes two projections extending outwardly from a lower side edge of the body portion, wherein each of the two projections from the lower side edge of the body portion is configured to abut opposing stringers of the stairway.

14. A stairway as defined in claim 13, wherein each of the two projections is in the form of a tab flange defining a hole for receiving a fastener therethrough.

15. A method of installing an adjustable riser between adjacent stairs of a stairway comprising an upper tread and a lower tread, the method comprising the steps of:

placing an adjustable riser having a lower end, a body portion and an upper end between the upper tread and the lower tread;

adjusting the spacing between the upper end and the lower end such that an upper connecting portion extending from the upper end is aligned over a front portion of the upper tread of the stairway, and such that a lower connecting portion extending from the lower end is aligned over a rear portion of the lower tread of the stairway, wherein the lower connecting portion abuts a rear end of the lower tread; and coupling the upper connecting portion to the upper tread and the lower connecting portion to the lower tread, such that a gap is formed between the lower end of the riser and the lower tread.

16. A method of installing an adjustable riser between adjacent stairs of a stairway, comprising an upper tread and a lower tread that are transversely installed between opposing stringers of the stairway, the method comprising the steps of:

placing an adjustable riser having a body portion between the upper tread and the lower tread;

adjusting the spacing between an upper end and a lower end of the body portion such that an upper connecting portion extending from the body portion adjacent to the upper end is aligned over at least one of the opposing stringers of the stairway, and such that a lower connecting portion extending from the body portion adjacent to the lower end is aligned over at least one of the opposing stringers of the stairway; and coupling the upper connecting portion and the lower connecting portion to at least one of the opposing stringers of the stairway, wherein the spacing between the upper tread and the lower tread defines an opening, and the adjustable stair riser is placed to only partially obstruct the opening, thereby leaving a gap between the stair riser and the lower tread.

* * * * *

UNITED STATES PATENT AND TRADEMARK OFFICE

CERTIFICATE OF CORRECTION

PATENT NO. : 8,297,010 B2
APPLICATION NO. : 12/403409
DATED : October 30, 2012
INVENTOR(S) : Stephen Giarratana It is certified that error appears in the above-identified patent and that said Letters Patent is hereby corrected as shown below:

Column 6, Claim 7, line 24, please delete the word "each" after the word 'projections'.

Column 6, Claim 7, line 24, please change the word "are" to --is-- after the word 'projections'.

Column 6, Claim 9, line 33, please add the word --transverse-- before the word 'side'.

Signed and Sealed this
Fifth Day of February, 2013

Teresa Stanek Rea
*Acting Director of the United States Patent and Trademark Office*